US008985327B2

(12) United States Patent
Roesler

(10) Patent No.: US 8,985,327 B2
(45) Date of Patent: Mar. 24, 2015

(54) PACKAGING CASE WITH CLAMP-TYPE HOLDER FOR OBLONG OBJECTS

(71) Applicant: Peter Roesler, Wangen (DE)

(72) Inventor: Peter Roesler, Wangen (DE)

(73) Assignee: Rose Plastic AG (DE)

( * ) Notice: Subject to any disclaimer, the term of this patent is extended or adjusted under 35 U.S.C. 154(b) by 271 days.

(21) Appl. No.: 13/621,431

(22) Filed: Sep. 17, 2012

(65) Prior Publication Data

US 2013/0068645 A1 Mar. 21, 2013

(30) Foreign Application Priority Data

Sep. 16, 2011 (DE) ..... 20 2011 105 720 U

(51) Int. Cl.

| | |
|---|---|
| ***B65D 85/28*** | (2006.01) |
| ***B65D 85/24*** | (2006.01) |
| ***B65D 25/10*** | (2006.01) |
| ***B65D 85/38*** | (2006.01) |

(52) U.S. Cl.

CPC ..... *B65D 85/24* (2013.01); *B65D 25/103* (2013.01); *B65D 85/38* (2013.01)

USPC ..... 206/379; 206/477; 206/486

(58) Field of Classification Search

USPC ..... 206/349, 372–379, 443, 446, 477, 486; 211/69, 70.6; 220/8

See application file for complete search history.

(56) References Cited

U.S. PATENT DOCUMENTS

| | | | | |
|---|---|---|---|---|
| 1,024,388 | A * | 4/1912 | Bartlett | 206/379 |
| 4,768,652 | A * | 9/1988 | Fallon | 206/373 |
| 7,677,390 | B2 * | 3/2010 | Roesler | 206/379 |
| 7,740,136 | B2 * | 6/2010 | Roesler | 206/379 |
| 8,113,342 | B2 * | 2/2012 | Sonoda et al. | 206/14 |
| 8,181,773 | B2 * | 5/2012 | Guenter et al. | 206/63.5 |
| 2003/0155274 | A1 * | 8/2003 | Rosler | 206/591 |
| 2004/0045867 | A1 * | 3/2004 | Appelbaum | 206/807 |
| 2006/0283769 | A1 * | 12/2006 | Roesler | 206/588 |
| 2007/0138043 | A1 * | 6/2007 | Roesler | 206/379 |

* cited by examiner

*Primary Examiner* — Luan K Bui

(74) *Attorney, Agent, or Firm* — Cohen & Grigsby, P.C.

(57) ABSTRACT

A packaging case (1) for oblong objects such as high-quality precision tools (5), having a body (4) with a longitudinal receiving and removal opening (34), that can be closed by a protective element 2). The body (4) has a base (6) to which a clamping part (8) with at least one flexibly deformable U-shaped clamping jaw (9) is attached. The base part (6) is divided into a lower part (12) that is securely connected to the clamping part (8) and an upper part (11) that is attached to the lower part (12) such that when the upper part (11) is in an open position, the space (23) around the free end of the tool 5) is accessible, but when the upper part 11) is in the closed position the space around the free end of the tool is blocked.

11 Claims, 4 Drawing Sheets

PACKAGING CASE WITH CLAMP-TYPE HOLDER FOR OBLONG OBJECTS

Figures 1, 2:
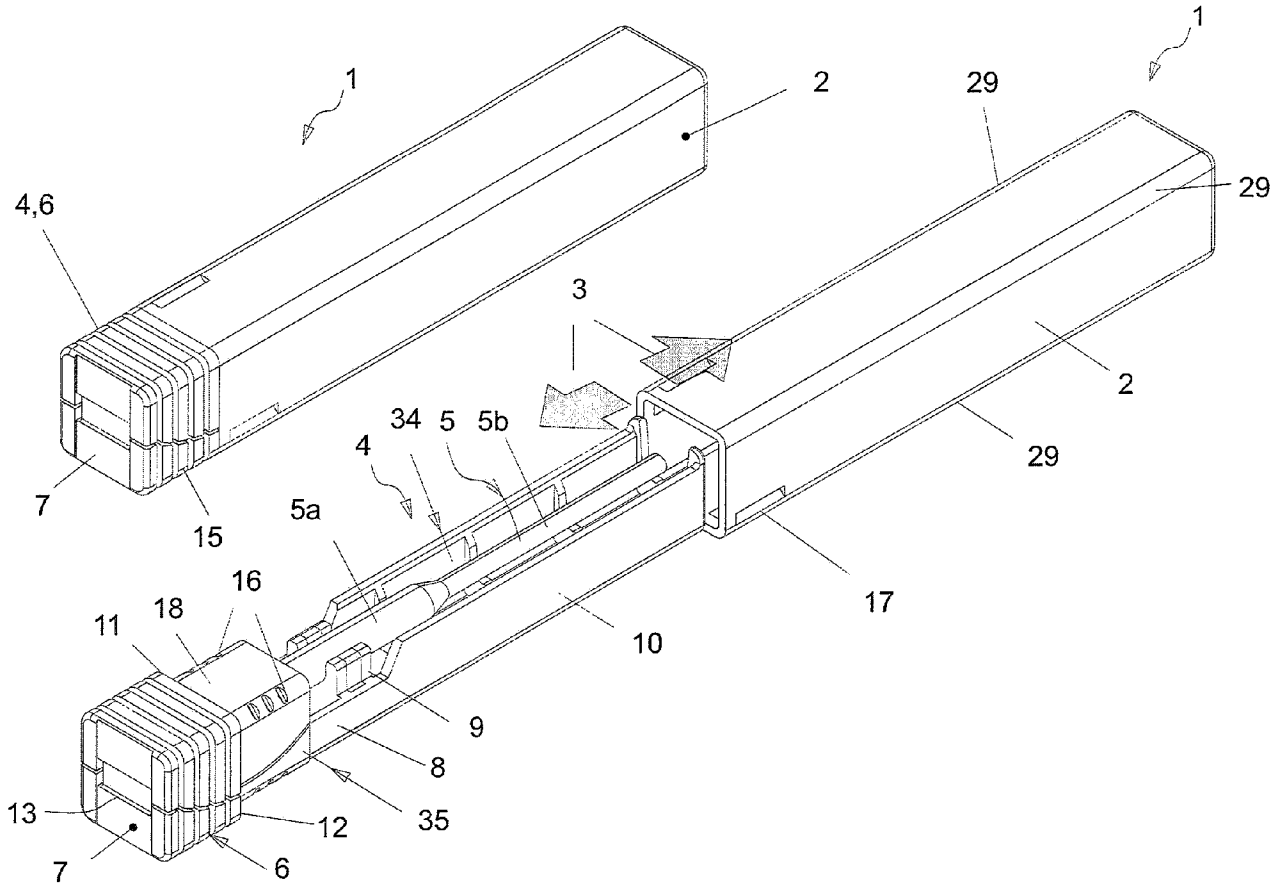

The invention relates to a packaging case with a clamp-type holder for oblong objects, particularly for small, lightweight, high-quality precision tools, according to the preamble of claim 1.

Numerous generic packaging cases of this type having a clamp-type holder are known in the prior art.

For example, DE1896500 U1, DE 8336978 U1, DE 8904671 U1, DE 19715030 A1 and WO 2005/067390 A2 disclose a packaging case having two or three flexibly spring-mounted U-shaped clamping jaws, spaced from one another, into the U-shaped recesses of which an oblong object can be clipped and thereby held by friction and optionally interlocking therein.

DE 102005022385 A1 discloses a packaging case consisting of a holder and a protective cap that can be pushed onto said holder axially, wherein the holder consists of a base and an upper part, each having an axial groove that is open radially on one side for a clamping support of the tool. Base and upper part are attached to one another by a bendable film hinge, which allows the shank or the cutting region of the tool to be optionally freely accessed.

DE 102005060439 B3 discloses a packaging case consisting of a holder and a protective cap that can be pushed axially onto said holder, wherein the holder has clamping jaws that are flexibly spring-mounted in a radial direction, between which a radially inner receiving space for receiving a tool is defined. The shank of the tool is inserted axially into the receiving space of the holder, causing the clamping jaws to move radially outward slightly, resulting in a light clamping force acting on the shank of the tool. The protective cap is then pushed axially onto the holder, so that the clamping jaws are pressed more strongly inward radially onto the shank of the tool, thereby substantially increasing the clamping force. The disadvantage is that there are only two clamping forces, a very low clamping force and a very high clamping force.

DE 102007005515 B3 discloses a packaging case comprising a lower base having an axial receiving opening for receiving a loosely guided shank of a tool, and a protective part, arranged pivotably on the base, with a clamping part for fixing the tool in place between axially lower U-shaped clamping jaws. Base and protective part can be connected to one another by means of a protective cover that can be pushed on and latched, whereby an additional clamping force is applied via the clamping jaws to the tool, and the case is closed.

The disadvantage of the above-described prior art packaging case is that the clamping force of the clamping elements is relatively constant once the oblong object has been clamped in, and during insertion or removal of the oblong object, either a relatively high level of manual force must be applied in the case of a more secure clamp-type holder, or a relatively low level of manual force must be applied in the case of a weaker clamp-type holder. If the clamping force, and therefore the manual force, is too great, the held object must be forcefully clipped into its holder or pulled out of its holder, which can result in damage to the held object, to the packaging case, and/or to the surrounding area, and can even result in injury to the user or to other persons. If the clamping force, and therefore the manual force, is too low, then during insertion of the object into the packaging case and while the packaging case is unopened, damage to the held object and/or to the packaging case can result, and during insertion of the object into the packaging case and when the packaging case is open, damage to the surrounding area or even injury to the user or to other persons may result.

In DE 102005060439 B3, although a 2-stage clamping force of the clamping jaws on the shank of the tool is disclosed, an additional protective part for protecting the head of the tool during removal of the protective cover is not disclosed. Moreover, in this case the tool shank is merely clamped into the base, so that once the protective cover has been pulled off, the tool head must be grasped to remove the tool, however, this must be avoided particularly in the case of highly sensitive or sharp-edged tools. Furthermore, the clamping force of the base without the protective cover is either zero or relatively low, so that receiving and removing sensitive tools while the case is resting horizontally is associated with a high risk of damage.

DE 102007005515 B3 also discloses a 2-stage clamping force of the clamping jaws on the shank of the tool, but rather than being in the base, it is in the axially lower clamping part of the axially upper protective part. Once the protective cover has been removed axially and the protective and clamping part has been pivoted away, the shank of the tool is only loosely guided in the base, so that once again, receiving and removing sensitive tools while the case is resting horizontally is associated with a high risk of damage. A high risk of damage to sensitive tools also results from the fact that base and protective/clamping part are pivotably connected to one another via a film hinge. Therefore, if the protective cover is not removed precisely axially, the clamping of the clamping part can be at least partially released before the protective cover has been fully removed, resulting in a bending between base and protective/clamping part, so that the sensitive tool head is then at risk of bumping against the inner wall of the protective cover and becoming damaged.

The problem addressed by the present invention is therefore that of further developing a cost-effective, generic packaging case such that said case will securely accommodate the object held therein with relatively high clamping force until its ultimate removal, and will enable safe receiving and removal with relatively low receiving and removal force.

This problem is solved by the features of independent claim 1.

The essential feature according to claim 1 is that the base part is divided at least into an upper part and a lower part, wherein the lower part is connected securely to the clamping part, and wherein the upper part is attached or can be attached to the lower part in such a way that the space for accommodating the free end of the tool shank is freely accessible to finger access by a user when the upper part is in at least one opened position, but is blocked when the upper part is in the closed position.

The advantage of this is that it allows the object to be easily received in and removed from the packaging case without damage or injury, and that only a deliberate receiving and removal of the object is possible, and an unintentional release of the tool from the clamp-type holder is nearly ruled out.

The protective element is preferably a protective shell which is open at least in the direction of the base, and which can be pushed axially onto and off of the base body in the sliding directions. However, the protective shell can also have additional open regions or sides—what is important is only that the opening for receiving and removing the base can be closed with said shell. Therefore, the protective element can also be merely a flat strip that can be pushed or clipped on, which can also be slightly C-shaped, and can engage in grooves on the inner surfaces, lateral surfaces or rear surface of the base, but which always essentially closes off the front side of the base body.

Preferred is an asymmetrical bifurcation of the base part, approximately in the direction of axial longitudinal extension of the case, into upper part and lower part, wherein other subdivisions are also possible, for example, into 3 or more parts, or a symmetrical and/or angled dividing line, or an incomplete opening of the space for grasping the end of the tool shank by the upper part of the base. What is important, therefore, is only that access to the space for grasping the end of the tool shank is prevented when the upper part is in the closed position and is enabled when the upper part is in the opened position, so that unintentional contact with and release of the tool from its clamped position when removing or pushing on the protective shell is prevented.

Upper part and lower part are preferably connected to one another by a hinge, particularly an adhesive film hinge, the pivoting angle of which particularly ranges between ca. 90° and 180°, but can also be smaller or larger. Other re-releasable and re-connectable frictional and/or interlocking connection means can also be provided between upper part and lower part, such as bayonet connectors and other slide connectors, clamping connectors, locking/snapping connectors, Velcro closures, re-releasable and re-connectable adhesive connectors, e.g., by means of adhesive strips, cottered connectors, pin/eye hinge connectors, etc. The best connector, however, is a film hinge, with which upper part and lower part are adhesively and inseparably connected to one another in a cost-effective manner.

In particular, the lower part has a concave finger recess, as viewed in the direction of the receiving and removal opening, into which a complementary, convex bulge of the upper part projects in the closed state. At its deepest point, the finger recess extends approximately up to the lower side wall, and its dimensions are approximately the same as those of the cross-section of a finger of an average adult human, in other words, having a diameter of between 1.0 and 2.5 cm.

Further advantageously provided are two clamping jaws, spaced from one another, each having a U-shaped clamping space, however, in principle a single clamping jaw is sufficient, or 3 or more clamping jaws may also be provided, arranged spaced from one another longitudinally along the case. The basic shape of the clamping space of the clamping jaws can also be different from the U-shape, for example, a V-shape, a C-shape, an O-shape, or an oval shape, or can have a pot shape or some other polygonal shape. The shape of the clamping jaws therefore plays a subordinate role.

What is important, however, is that the clamping jaws are equipped in the direction of the clamping space with a friction-increasing insert, particularly made of TPE plastic material (thermoplastic elastomer), as a contact surface for support of the tool shank, whereby the tool is fixed in place axially and optionally radially by way of friction.

For additional radial force fitting of the tool shank, the clamping jaws have an undercut in the clamping space for encompassing the tool shank in an interlocking fashion; however this is not absolutely essential, since a purely radial and axial frictional connection is also sufficient in principle.

In the grasping space, an angled ramp is arranged, which serves to support the tool shank when a user presses in the grasping space with his finger. This ramp may also be omitted, however, in which case the tool shank rests in a somewhat less defined manner against the radial wall of the axially outer clamping jaw when the user presses on the free shank end of the tool.

The clamping force of the clamping jaws is increased to produce the total clamping force by a first additional clamping force applied by means of a clamping fork of the upper part, which rests on the lower part, and by a second additional clamping force applied by means of the protective shell, which is pushed onto the recessed area of the base.

All parts of the packaging case of the invention are preferably made of plastic, wherein the protective cover is produced in a plastic hollow blow-molding process, while the base with the protective part and clamping part are produced as injection molded plastic parts.

The packaging case of the invention can have any cross-sectional shape, in other words, it may be circular, elliptical, oval or polygonal, particularly square.

In what follows, the invention will be specified in greater detail in reference to drawings of one embodiment.

The drawings show

Figure 3:
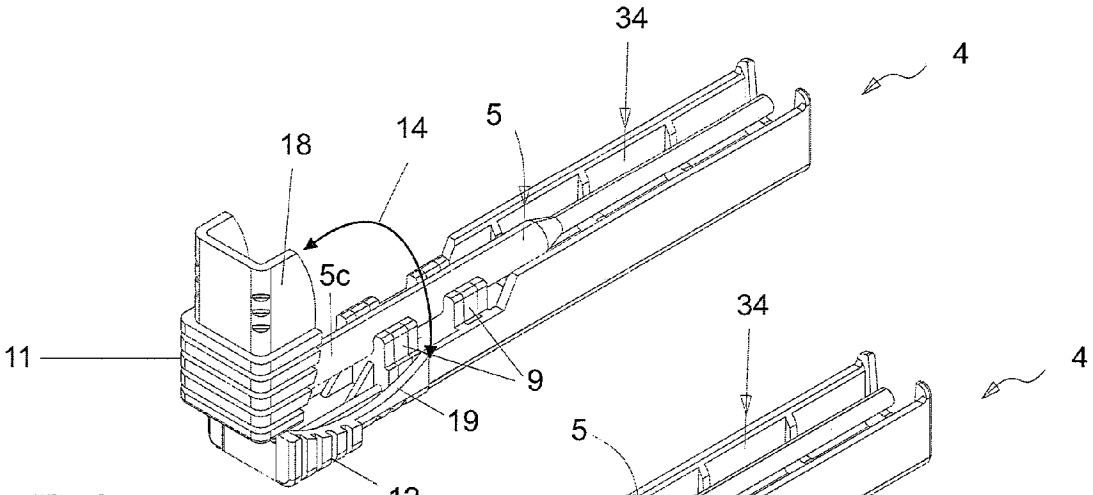
Figure 4:
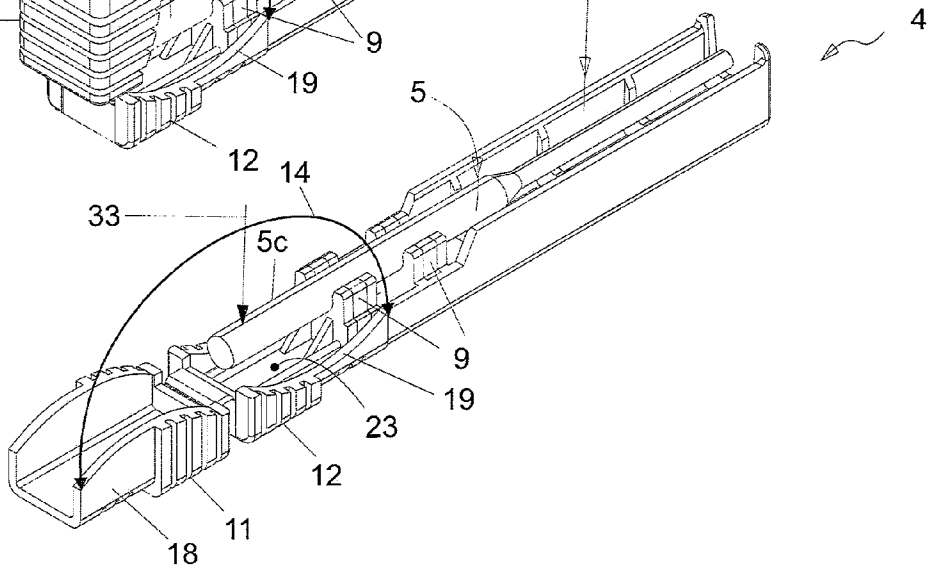
Figure 5:
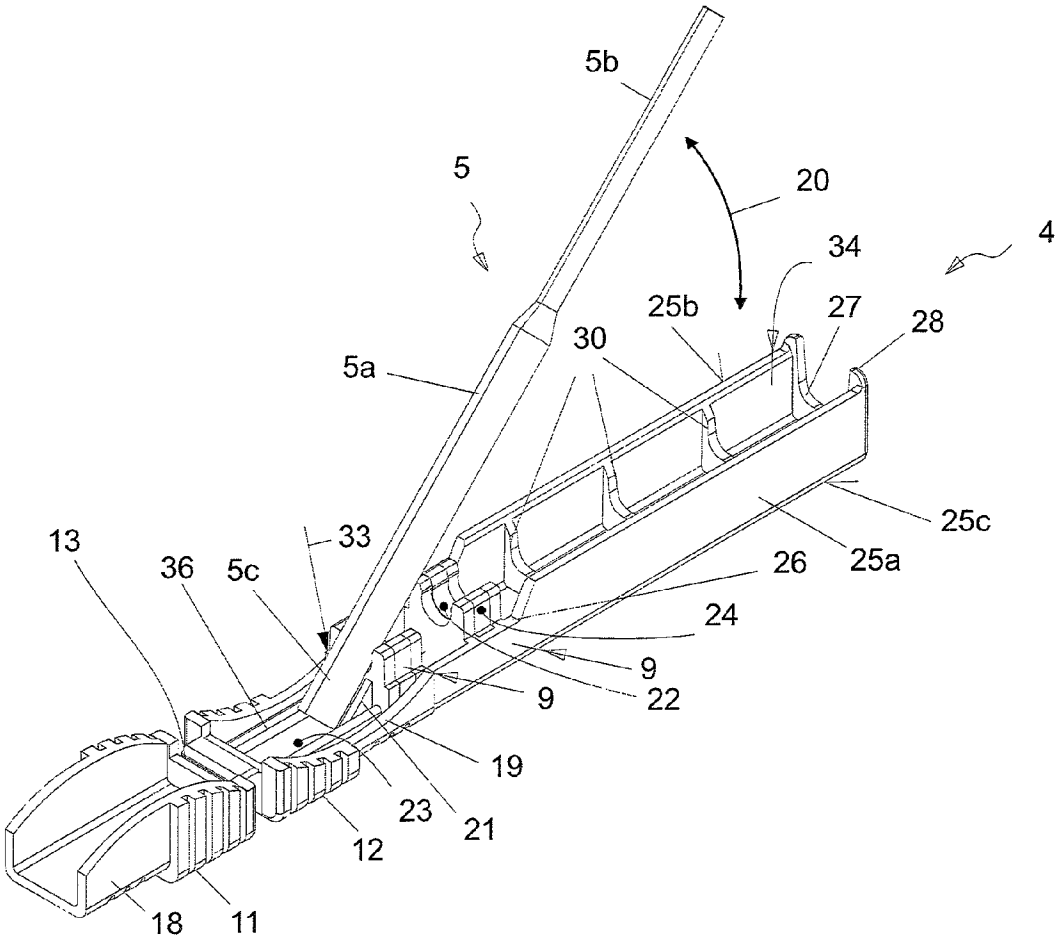
Figure 6:
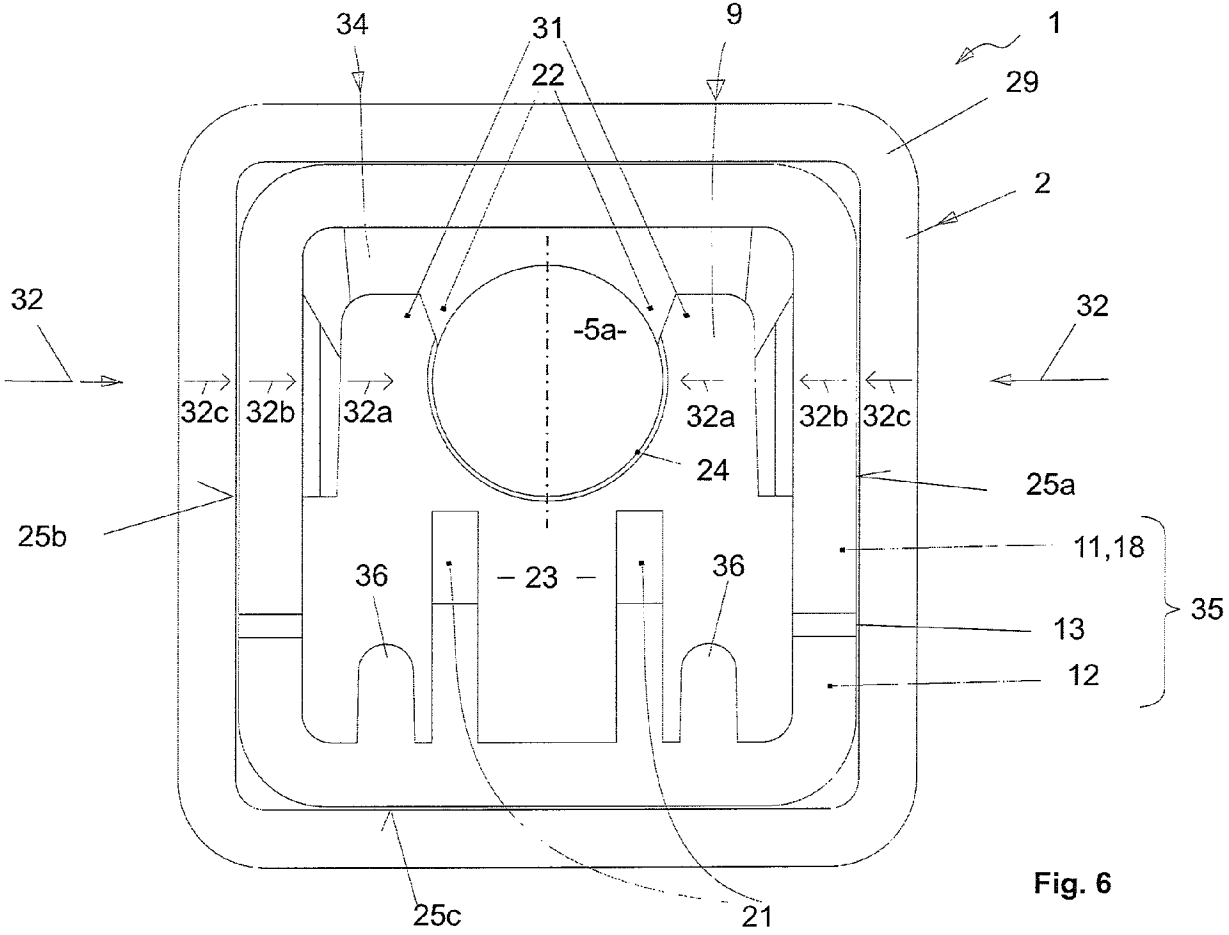

FIG. 1: A perspective view of the packaging case according to the invention in the closed state;

FIG. 2: the packaging case according to FIG. 1 with the protective cover pushed completely off of the base body;

FIG. 3: the base body of FIG. 2 with the upper part of the base pivoted 90° upward;

FIG. 4: the base body of FIGS. 2 and 3 with the upper part of the base pivoted 90° and 180°, respectively, into the support plane;

FIG. 5: the base body of FIG. 4 with the tool tilted upward by 45°;

FIG. 6: a schematic end view in the axial longitudinal direction of the packaging case according to FIG. 1 with the base removed.

According to FIGS. 1, 2 and 6, the packaging case 1 according to the invention comprises two parts, specifically an outer protective shell 2, which is embodied to be pushed onto the base body 4 and removed completely therefrom in the axial sliding directions 3, so that the protective shell 2 can be completely separated from the base body 4.

A tool 5 can be inserted into the inner cavity of the base body 4 from the top via the receiving and removal opening 34, and can be held there, clamped by its tool shank 5*a*, thereby securing it by means of frictional and interlocking force from falling out radially, and securing it against sliding axially in sliding directions 3 only by way of the interlocking closure.

The receiving and removal opening 34 according to FIG. 4 is configured such that the entire upper side wall of the base body 4 is absent, allowing access by a user to the inner cavity of the base body 4 and to the tool 5 held therein.

According to FIGS. 3-5, the base body 4 consists of a base part 6, on the bottom side 7 of which the entire case 1 can stand in its closed state. The base body 4 further consists of a clamping part 8, in which two U-shaped clamping jaws 9 are located, spaced from one another, which are embodied as open toward the receiving and removal opening 34. The base body 4 further consists of a protective part 10, which encompasses the head part 5*b* of the tool 5 to protect it, but without coming into contact with it.

The base part 6 is configured in 2 parts according to the invention, with an upper part 11 and a lower part 12, which are articulated to one another via a film hinge 13, so that the upper part 11 can be pivoted relative to the lower part 12 around at least 180° in pivoting directions 14. What is important is that the lower part 12 is integrally connected securely to the clamping part 8, which is in turn integrally connected securely to the protective part 10.

The clamping jaws 9 are arranged in the clamping part 8 in such a way that the free end 5*c* of the tool 5 projects freely into the grasping space 23 of the base 6, without requiring any further type of support there. The entire tool 5 is supported only with its tool shank 5*b* on the clamping jaws 9 and otherwise is not supported anywhere on the base body 4.

When the upper part 11 is in the closed position, as illustrated in FIGS. 1, 2 and 6, the receiving and removal opening 34 is covered by said upper part, so that no access—including unintended access—to the free end 5*c* of the tool 5 by the user can occur. When the upper part 11 is in the open position, as illustrated in FIGS. 3, 4 and 5, however, the receiving and removal opening 34 is uncovered and is not blocked by the upper part 11, giving a user free access to the free end 5*c* of the tool 5. The user must therefore deliberately pivot the upper part 11 away from the lower part 12, and only after doing so will he have access to the free end 5*c* of the tool shank 5*c*. Therefore, when pulling the protective shell 2 off of the base body 4 with one hand, the user is reliably prevented from accidentally touching the free end 5*c* of the tool shank 5*a* with his other hand, and releasing the tool 5 from its clamped position in the clamping jaws 9, allowing it to become damaged, or to damage the package or the surrounding area, or to injure the user or other persons.

The base 6 is equipped with gripping beads 15 around its entire circumference, which a user can grasp. The external dimensions of the axial inner recessed area 35 of the base 6 are decreased such that the inner surface of the protective shell 2 rests on the outer surface thereof, and the associated latching elements 16, 17 can latch one into the other, so that the protective shell 2 is secured onto the base body 4 against unintentional removal.

At the same time, the axially inner half of the upper part 11 of the base 6 serves in the form of a clamping fork 18 to provide an additional clamping force 32*b* for the clamping force 32*a* of the clamping jaws 9 when the upper part 11 is pivoted onto the lower part 12 of the base 6 in pivoting directions 14. The inner surface of the base 6 therefore rests on the radial outer surface of the axially lower clamping jaw 9, so that increased force 32*a* plus 32*b* must be applied in order to release the clamping. Base part 6 and clamping part 8 therefore overlap slightly in the region of the axial outer clamping jaw 9. In contrast, the axially inner clamping jaw 9 remains free from this clamping fork 18 of the upper part 11 of the base 6 and therefore of the additional clamping force 32*b*. In a variant not illustrated here, however, the second and optionally additional clamping jaws 9 can also be overlapped by the clamping fork 18 of the upper part 11 of the base 6, however this does not result in a distribution of the additional clamping force 32*b* to the two or more clamping jaws, and therefore does not result in any greater total clamping force.

Upper part 11 and lower part 12 of the base 6 are asymmetrically divided, wherein the axial dividing line or dividing plane is rounded inward concavely from the longitudinal center line of the case 1 into the lower part 12 in the form of a finger recess 19, so that a user's fingertip (e.g., thumb) fits well into it, allowing him to press on the free end 5*c* of the shank 5*a* of the tool 5, which is located in the grasping space 23 of the clamping part 8, in the direction of finger movement 33, in the manner of a mikado pin, and thereby tilt the entire tool 5 upward in tilting direction 20.

As the angular boundary for tilting the tool 5 upward, a ramp 21 is used, which is provided here between the axially outer clamping jaws 9 and the inner surface of the base 6, and in this case has an angle of 45°, but can also have other angular degrees, such as 30° or 60°, for example. At this angular degree of 45°, the tool then protrudes outward at the top and can be easily and safely grasped by the user with his other hand, and removed from the case 1.

On the clamping part 8, two U-shaped clamping jaws 9 are provided, spaced axially from one another, each of which defines a U-shaped clamping space 22, and between which an intermediate space is formed. With a pair of clamping jaws 9, an axial deviation in the positioning of the tool 5 can be minimized.

Friction-increasing materials 24, particularly thermoplastic elastomers (TPE), are included in the clamping space 22, on which the tool shank 5*a* is then adhesively and/or frictionally supported in a clamping fashion, thereby preventing axial displacement of the tool 5.

In the region of the clamping jaws 9, the height of the two opposite side walls 25, on which the clamping jaws 9 are fastened, is reduced by way of a recess 26, so that only the clamping jaws 9 are then flexibly spring-mounted radially outward, without the outer wall 25 of the base body 4 providing a substantial increase in bending resistance.

The end face 27 that is opposite the base 6 is embodied as open with the exception of a residual reinforcement piece, so that even longer tools 5 may be held projecting beyond the end wall 27, however, this is intended to occur only as an exceptional case.

The corners 28 that are located opposite the base 6 are cambered slightly to the somewhat lower side walls 25, so that said corners fit as precisely as possible into the edges 29 of the protective shell 2 and can be guided there with a low level of play but a low level of friction.

In the inner cavity of the protective part 10 of the base body 4, a number of reinforcement ribs 30 are provided, mutually spaced and extending crosswise, wherein the end face 27 is reduced to similar dimensions to the reinforcement ribs 30.

FIG. 6 shows the undercut 31 of the U-shaped clamping jaws 9, known in the art, whereby an additional interlocking connection to the three clamping forces 32 is achieved. The first clamping force 32*a* achieved by the prestressing of the flexible U-shaped clamping jaws 9, the second clamping force 32*b* is achieved by the clamping fork 18 of the upper part 11 of the base 6, which presses radially from the outside onto at least one clamping jaw 9, and the third clamping force 32*c* is achieved by the protective shell 2, which is pushed onto the recessed area of the base 35, wherein all three individual clamping forces 32*a*, 32*b*, 32*c* are combined to make up a total clamping force 32.

FIGS. 3-6 also show two stabilizing ribs 36 spaced from one another and extending axially lengthwise on the base 25*c* of the base body 4 in the removal opening 23.

Thus when the case 1 is to be opened and the tool 5 contained therein removed, the case 1 is first moved from its standing surface 7 to the horizontal position according to FIG. 1, with the receiving and removal opening 34 pointing upward.

The case 1 is then grasped by the base 6 with one hand, according to FIG. 2, and with the other hand, the free end of the protective shell 2 is grasped and the protective shell 2 and the base body 4 are moved relative to one another in the axial sliding directions 3 and thereby separated from one another. The receiving and removal opening 34 with the tool 5 stored therein is then visible from the top. Throughout the entire process, the base 6 remains firmly grasped within the fingers of one hand, so that the upper part 11 cannot become separated from the lower part 12.

The upper part 11 of the base 6 is then pivoted upward in pivoting direction 14, according to FIG. 3, until it reaches the position shown in FIG. 4, so that the upper part 11 has been pivoted 180° relative to the lower part 12 and has been placed on the base aligned with the lower part 12 or the rest of the base body 4.

Using a thumb, for example, the user can then press in the finger recess 19 in the direction of finger pressure 33 onto the free end 5*c* of the tool 5, tilting the entire tool 5 upward in tilting direction 20 and releasing the clamping of the clamping jaws 9. The tool shank 5*a* can then be grasped with the other hand, and can be safely removed from the case 1.

Inserting a tool 5 into the case 1 is carried out in precisely the same manner, but in reverse sequence, wherein first, with one hand, the free end 5*c* of the tool shank 5*a* is placed on the ramp 21 and the tool shank 5*a* is then pivoted downward with the other hand in the pivoting direction 14 onto the clamping jaws 9, where it is clipped in. At that point, the tool 5 is fixed in position and the upper part 11 can be folded onto the lower part 12 and held together with one hand, while with the other hand, the protective shell 2 is slid onto the recessed area of the base 35 until it is latched.

Receiving and removal can be carried out in the same or a similar manner either manually or automatically by means of a manipulator and/or a loading robot.

LEGEND FOR DRAWINGS

1. Packaging case
2. Protective shell
3. Sliding directions for 2 and 4
4. Base body
5. Tool; 5*a* Shank; 5*b* Head; 5*c* free end of shank 5*a*
6. Base part of 4
7. Bottom side of 6
8. Clamping part of 4
9. Clamping jaws
10. Protective part of 4
11. Upper part of 6
12. Lower part of 6
13. Film hinge between 11 and 12
14. Pivoting directions
15. Gripping bead
16. Latching elements on base
17. Latching elements on protective shell
18. Clamping fork
19. Finger recess
20. Tilting direction
21. Ramp
22. Clamping space
23. Receiving space for 5*c* and grasping space for finger of a user
24. Insert with increased friction (e.g., TPE)
25. Side walls of 4
26. Lowered area
27. End face
28. Cambered corners
29. Edges of protective shell
30. Reinforcement ribs
31. Undercut
32. Clamping force direction; 32*a*, 32*b*, 32*c* clamping force
33. Direction of finger pressure
34. Receiving and removal opening of 4
35. Recessed area of base
36. Stabilization ribs in 23

The invention claimed is:

1. A packaging case for storing an oblong object said packaging case comprising:

a protective part that defines a cavity with a receiving and removal opening;

a clamping part that is integrally attached to said protective part, said clamping part including at least one flexibly deformable clamping jaw that is adapted to receive an oblong object that is placed through the longitudinal receiving and removal opening of said protective part;

a base that defines a grasping space around one end of an oblong object that is received said clamping part, said base having a lower part that defines a recessed area and that is integrally connected to said clamping part, said base also having an upper part that defines a clamping fork at one end and that is pivotally connected to the lower part at the opposite end such that, at times when the upper part of said base is pivoted away from said lower part, said upper part has an open position wherein said grasping space for the end of the oblong object is accessible by a user and such that, at times when said upper part is pivoted together against the lower part of said base, said upper part has a closed position wherein user access to said grasping space is blocked and the clamping fork of said upper part engages a side of said at least one clamping jaw and also engages the opposite side of said at least one clamping jaw to further bias said clamping jaw together; and an outer shell that moves in an axial direction over said protective part and at least a portion of said base to open said packaging case and that moves in an axial direction off of said protective part and at least a portion of said base to open said packaging case.

2. The packaging case according to claim 1 wherein the outer shell is closed on at least the side of the protective part that defines the longitudinal receiving and removal opening, said outer shell being slidingly displaceable along the longitudinal direction of the packaging case.

3. The packaging case according to claim 2 wherein the base is split into the upper part and the lower part, approximately in the direction of the longitudinal axis of the case.

4. The packaging case according to claim 3 wherein the upper part of the base and the lower part of the base are connected by a film hinge that pivots through an angle in the range between 90° and 180° .

5. The packaging case according to claim 3 wherein said protective part defines a lower sidewall and wherein the lower part of the base defines a finger recess in which the deepest point of said recess extends approximately to the lower sidewall of the protective part.

6. The packaging case according to claim 3 wherein said clamping part includes two clamping jaws that are spaced axially from one another, each of said clamping jaws having a U-shaped clamping space.

7. The packaging case according to claim 6 wherein each of said clamping jaws have a friction-increasing insert of TPE-plastic material that is located in a U-shaped clamping space to support the oblong object.

8. The packaging case according to claim 6 wherein the clamping space of each of said clamping jaws has an undercut for encompassing the oblong object in an interlocking manner.

9. The packaging case according to claim 5 wherein an angled ramp is located in the grasping space, said ramp supporting the oblong object at times when force in the direction toward said lower sidewall is applied against a portion of the oblong object that is located in the grasping space.

10. The packaging case according to claim 3 wherein the upper part of said base includes a clamping fork, said clamping fork having tines that urge against said clamping part in opposite directions at times when said upper part is closed against said lower part to provide a first additional clamping force -to the clamping force of said at least one clamping jaw, and wherein said base further includes a recessed area that opposes an inner surface of said protective shell at times when said protective shell is slidingly placed over said recessed area to provide a second additional clamping force to the clamping force of said at least one clamping jaw, said second additional clamping force being additive to the clamping of said at least one clam jaw and said first additional clamping force to provide a total clamping force for each clamping jaw.

11. The packaging case of claim 1 wherein said outer shell moves over said protective part and the recessed area of said lower part of said base and the clamping fork of the upper part of said base to close said packaging case, and wherein said outer shell moves off of the recessed area of said lower part of said base and the clamping forks of said upper part of said base and said protective part to open said packaging ease.

* * * * *